US009716317B2

(12) United States Patent
Chatani et al.

(10) Patent No.: US 9,716,317 B2
(45) Date of Patent: Jul. 25, 2017

(54) ANTENNA DEVICE, COMMUNICATION MODULE, PORTABLE ELECTRONIC APPARATUS, AND COMMUNICATION METHOD USING PORTABLE ELECTRONIC APPARATUS

(75) Inventors: Kenichi Chatani, Sendai (JP); Naoharu Yamamoto, Sendai (JP); Toshiaki Oka, Sendai (JP); Takashi Otsuki, Sendai (JP)

(73) Assignee: NEC TOKIN CORPORATION, Tokyo (JP)

( * ) Notice: Subject to any disclaimer, the term of this patent is extended or adjusted under 35 U.S.C. 154(b) by 259 days.

(21) Appl. No.: 14/111,998

(22) PCT Filed: Apr. 22, 2011

(86) PCT No.: PCT/JP2011/059980

§ 371 (c)(1),
(2), (4) Date: Oct. 15, 2013

(87) PCT Pub. No.: WO2012/144077

PCT Pub. Date: Oct. 26, 2012

(65) Prior Publication Data

US 2014/0035790 A1 Feb. 6, 2014

(51) Int. Cl.

| | |
|---|---|
| ***H01Q 7/08*** | (2006.01) |
| ***H01Q 7/06*** | (2006.01) |
| ***H01Q 1/38*** | (2006.01) |
| ***H01Q 1/22*** | (2006.01) |

(52) U.S. Cl.
CPC ..... *H01Q 7/06* (2013.01); *H01Q 1/2216* (2013.01); *H01Q 1/38* (2013.01)

(58) Field of Classification Search
CPC ..... H01Q 1/38; H01Q 7/06
See application file for complete search history.

(56) References Cited

U.S. PATENT DOCUMENTS

| | | | |
|---|---|---|---|
| 7,710,341 | B2 | 5/2010 | Kubo et al. |
| 8,259,023 | B2 | 9/2012 | Kubo et al. |
| 8,314,743 | B2 | 11/2012 | Kubo et al. |

(Continued)

FOREIGN PATENT DOCUMENTS

| | | | |
|---|---|---|---|
| EP | 2083478 | A1 | 7/2009 |
| JP | 2000-048152 | A | 2/2000 |

(Continued)

OTHER PUBLICATIONS

Extended European Search Report dated Dec. 22, 2014, issued in counterpart European Application No. 11863722.2.

(Continued)

*Primary Examiner* — Trinh Dinh
(74) *Attorney, Agent, or Firm* — Holtz, Holtz & Volek PC

(57) ABSTRACT

An antenna device, which has wide-angle directivity and a configuration suitable to be used in a portable electronic apparatus, includes a flat board-like substantially rectangular soft magnetic body, and a loop-shaped coil disposed from a front surface to a rear surface of the soft magnetic body such that a region surrounded by the coil includes at least a part of a specific edge, i.e., one edge out of four edges of the soft magnetic body, and does not include a facing edge that faces the specific edge.

10 Claims, 17 Drawing Sheets

(56) References Cited

U.S. PATENT DOCUMENTS

| | | | | |
|---|---|---|---|---|
| 9,136,600 | B2 * | 9/2015 | Yosui | H01Q 1/2225 343/787 |
| 9,306,284 | B2 * | 4/2016 | Yosui | H01Q 1/2225 343/787 |
| 2005/0231330 | A1 | 10/2005 | Drews et al. | |
| 2007/0247387 | A1 * | 10/2007 | Kubo | H01Q 7/08 343/787 |
| 2007/0252763 | A1 | 11/2007 | Martin | |
| 2009/0096694 | A1 * | 4/2009 | Ito | G06K 19/07749 343/788 |
| 2009/0189729 | A1 | 7/2009 | Kubo et al. | |
| 2010/0156729 | A1 * | 6/2010 | Kubo | G06K 7/10316 343/702 |
| 2010/0309081 | A1 | 12/2010 | Kobayashi et al. | |
| 2012/0038443 | A1 * | 2/2012 | Kubo | G06K 7/10336 336/90 |
| 2012/0081257 | A1 * | 4/2012 | Yosui | H01Q 1/2225 343/788 |
| 2012/0081258 | A1 * | 4/2012 | Yosui | H01Q 7/08 343/788 |
| 2012/0280867 | A1 * | 11/2012 | Baek | H01Q 1/2283 343/700 MS |

FOREIGN PATENT DOCUMENTS

| | | | |
|---|---|---|---|
| JP | 2001-028510 | A | 1/2001 |
| JP | 2001-266100 | A | 9/2001 |
| JP | 2004-266811 | A | 9/2004 |
| JP | 2004-348497 | A | 12/2004 |
| JP | 2005-033461 | A | 2/2005 |
| JP | 2005-525768 | A | 8/2005 |
| JP | 2005-275871 | A | 10/2005 |
| JP | 2005-333244 | A | 12/2005 |
| JP | 3933191 | B1 | 6/2007 |
| JP | 2007-524942 | A | 8/2007 |
| JP | 2007-325054 | A | 12/2007 |
| JP | 2008-028642 | A | 2/2008 |
| JP | 2009-206975 | A | 9/2009 |
| JP | 2009-212923 | A | 9/2009 |
| WO | WO 2008/018231 | A1 | 2/2008 |
| WO | WO 2009/078214 | A1 | 6/2009 |

OTHER PUBLICATIONS

International Search Report (ISR) dated Aug. 2, 2011 (and English translation thereof) in International Application No. PCT/JP2011/059980.

Japanese Office Action dated Nov. 11, 2010 (and English translation thereof) in counterpart Japanese Application No. 2010-029389.

Japanese Office Action dated Jun. 2, 2011 (and English translation thereof) in counterpart Japanese Application No. 2011-091948.

European Office Action dated Sep. 29, 2015, issued in counterpart European Application No. 11863722.2.

* cited by examiner

ANTENNA DEVICE, COMMUNICATION MODULE, PORTABLE ELECTRONIC APPARATUS, AND COMMUNICATION METHOD USING PORTABLE ELECTRONIC APPARATUS

TECHNICAL FIELD

This invention mainly relates to an antenna device which is used as a part of a communication module in a portable electronic apparatus.

BACKGROUND ART

When a communication antenna is arranged in a portable electronic apparatus such as a portable phone or another portable terminal, the antenna characteristics might be degraded, for example, due to the influence of eddy current generated in a metal case of the portable electronic apparatus and a conductive pattern on a circuit board which is located in the portable electronic apparatus. For example, Patent Document 1 discloses a technique to arrange a magnetic body in the vicinity of an antenna to solve such problem.

Some techniques relating to RFID (Radio Frequency IDentification) are disclosed in Patent Document 2 to Patent Document 4. Patent Document 2 discloses a technique relating to an RFID which copes with metal while each of Patent Document 3 and Patent Document 4 discloses a study relating to a communication along a direction other than a facing direction of a principal surface of a magnetic body.

PRIOR ART DOCUMENTS

Patent Document(s)

Patent Document 1: JP-A 2005-275871
Patent Document 2: JP-A 2007-325054
Patent Document 3: JP-B 3933191
Patent Document 4: JP-A 2005-33461

SUMMARY OF INVENTION

Technical Problem

A recent portable electronic apparatus has wireless communication function which is used not only for a telephone call but also in various daily scenes for a personal identification, a transaction of business or the like. Such personal identification or the like is performed by a user placing a portable electronic apparatus close to a reader/writer. In order to save labor for the action by the user under the personal identification or the like and to finish the process promptly, it is desirable that the angle, in which the portable electronic apparatus and the reader/writer face each other upon the data communication, can be varied in some amount. Accordingly, an antenna device provided in the portable electronic apparatus is required to have wider directivity.

Moreover, since the antenna device in the portable electronic apparatus should be arranged in limited space within the portable electronic apparatus together with the other components, its working condition is far different from an RFID tag which is attached to a periphery of a target commodity or product. Accordingly, if the structure of the RFID tag is simply applied to the antenna device in the portable electronic apparatus, various problems are caused.

It is therefore an object of the present invention to provide an antenna device having wide directivity and a structure suitable to be used in a portable electronic apparatus.

Solution to Problem

The present invention provides, as a first antenna device, an antenna device comprising a roughly rectangular plate-like soft magnetic body provided with a loop-like coil, wherein:

the coil is disposed from an front surface to a rear surface of the soft magnetic body so that an surrounded section surrounded by the coil includes, at least in part, a specific edge which is one of four edges of the soft magnetic body and that the surrounded section does not include an opposite edge opposite to the specific edge.

Moreover, the present invention provides, as a second antenna device, an antenna device which is the first antenna device, wherein:

the coil is a conductive pattern formed on an insulation sheet;

the coil of the conductive pattern is configured so that an area included in the surrounded section in the front surface of the soft magnetic body is larger than another area included in the surrounded section in the rear surface of the soft magnetic body; and the insulation sheet includes a level difference eliminating portion eliminating a level difference between a region including the conductive pattern and another region not including the conductive pattern when the antenna device is attached to an object, the level difference eliminating portion extending on the rear surface of the soft magnetic body from the conductive pattern toward the opposite edge of the soft magnetic body.

Moreover, the present invention provides, as a third antenna device, an antenna device which is the second antenna device, wherein the insulation sheet is provided with a slit which extends along a longitude direction of the specific edge, and is formed at a part thereof located on the specific edge.

Moreover, the present invention provides, as a fourth antenna device, an antenna device which is the second antenna device, wherein the insulation sheet is provided with an opening which is formed so as to include a region on the specific edge.

Moreover, the present invention provides, as a fifth antenna device, an antenna device which is one of the second to fourth antenna devices, wherein the insulation sheet extends on the front surface and the rear surface of the soft magnetic body from the specific edge beyond the opposite edge.

Moreover, the present invention provides, as a sixth antenna device, an antenna device which is one of the first to fifth antenna devices, wherein a thickness of the soft magnetic body is between 0.1 mm and 2.0 mm, both inclusive.

Moreover, the present invention provides, as a seventh antenna device, an antenna device which is one of the first to sixth antenna devices, wherein the surrounded section includes, at least in part, one adjacent edge which is adjacent to the specific edge of the soft magnetic body.

Moreover, the present invention provides a communication module comprising:

one of the first to seventh antenna devices; and a communication circuit connected with the antenna device.

Moreover, the present invention provides a portable electronic apparatus comprising the aforementioned communication module, a conductor and an insulator, wherein the communication module is arranged so that the rear surface of the soft magnetic body faces the conductor and that the antenna device is located over the conductor via the insulator.

Moreover, the present invention provides a method of communicating with a mating communication apparatus, by using the aforementioned portable electronic apparatus, in a wide angle range which is between a direction perpendicular to the front surface and the rear surface of the soft magnetic body and another direction perpendicular to the specific edge.

Moreover, the present invention provides a method of communication between the aforementioned portable electronic apparatus and another portable electronic apparatus, the communication utilizing electromagnetic induction effect.

Advantageous Effects of Invention

Since the coil of the antenna device according to the present invention is disposed from the front surface to the rear surface of the soft magnetic body so that the surrounded section includes, at least in part, the specific edge of the soft magnetic body, the antenna device can obtain directivity in wide angle between a direction perpendicular to the front surface of the soft magnetic body and another direction perpendicular to the specific edge.

Moreover, if the coil is formed of the conductive pattern provided on the insulation sheet and the insulation sheet extends to a region where the coil is not formed, the antenna device can be securely fixed to the inside of the portable electronic apparatus when the antenna device is attached to the inside of the portable electronic apparatus by using a double sided tape or the like.

DESCRIPTION OF EMBODIMENTS

Hereafter, an antenna device according to an embodiment of the present invention is explained in detail by referring to the accompanying drawings. This antenna device is connected with a communication circuit to form a communication module. Moreover, this communication module is arranged in a portable electronic apparatus over a conductor (a metal case or a conductive pattern on a circuit board which is located in the portable electronic apparatus) with an insulator placed between the communication module and the conductor.

Figure 1:
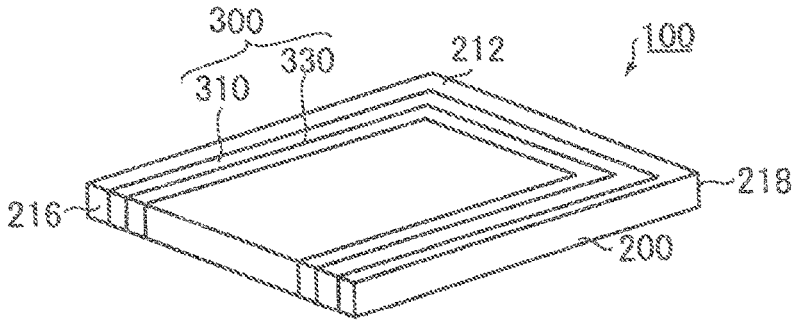
FIG. 1 is a top oblique view schematically showing an antenna device according to an embodiment of the present invention.
Figure 2:
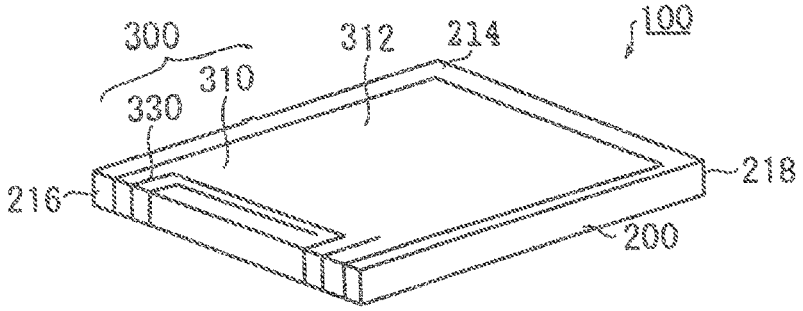
FIG. 2 is a bottom oblique view showing the antenna device of FIG. 1.

Referring to FIGS. 1 and 2, an antenna device 100 according to the present embodiment comprises a roughly rectangular plate-like soft magnetic body 200 and a coil sheet 300. The soft magnetic body 200 may be a sheet-like object having flexibility or a board-like object. In detail, the soft magnetic body 200 has a front surface 212 and a rear surface 214 as principal surfaces, and has four edges. In the present embodiment, specific one of the four edges of the soft magnetic body 200 is referred to as a specific edge 216 while another edge opposite to the specific edge 216 is referred to as an opposite edge.

A thickness of the soft magnetic body 200 is required to be equal to or more than 0.1 mm in order to prevent the antenna device 100 from being influenced by eddy current generated in a conductor (such as a metal case or a conductive pattern on a circuit board) which is arranged in the vicinity of the antenna device 100. However, if the thickness of the soft magnetic body 200 is over 2.0 mm, the antenna device 100 becomes large and goes against the requirement to make the portable electronic apparatus or the like thinner. Accordingly, the thickness of the soft magnetic body 200 is preferred to be between 0.1 mm and 2.0 mm, both inclusive.

Figure 3:
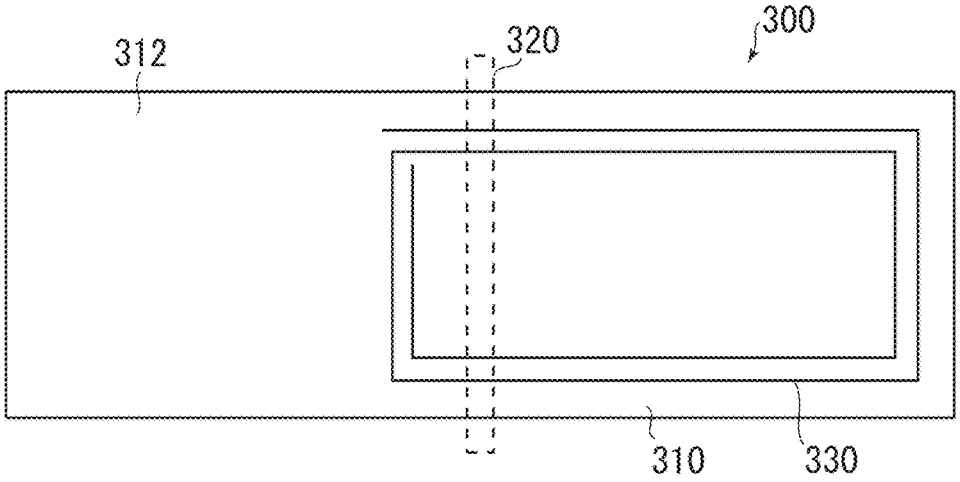
FIG. 3 is a view showing a coil sheet used in the antenna device of FIG. 1.

As shown in FIG. 3, the coil sheet 300 is a so-called FPC (Flexible Printed Circuits) where a coil 330 formed of a conductive pattern is formed on an insulation sheet 310. In detail, the coil 330 is formed on the insulation sheet 310 so as to include therewithin a part of a region 320 which corresponds to the specific edge 216. Thus, a surrounded section surrounded by the coil 330 and the region 320 partially overlap with each other on the insulation sheet. Accordingly, when the coil sheet 300 is bonded and fixed to the soft magnetic body 200, the coil 330 is disposed from the front surface 212 to the rear surface 214 of the soft magnetic body 200 so that the surrounded section surrounded by the coil 330 includes, at least in part, the specific edge 216 and that the surrounded section does not include the opposite edge 218. Although the illustrated coil has a winding number of two, the present invention is not limited to this embodiment. However, since a communication processing device in the portable electronic apparatus restricts inductance of the antenna device, the winding number is desired to be between two and seven.

Referring to FIGS. 1 to 3, in the present embodiment, the coil sheet 300 is configured so that an area, which is in the front surface 212 of the soft magnetic body 200 and included in the section surrounded by the coil 330, is larger than another area, which is in the rear surface 214 of the soft magnetic body 200 and included in the section surrounded by the coil 330. Especially, since the coil 330 according to the present embodiment is configured to have an area as large as possible in the front surface 212 of the soft magnetic body 200, the coil 330 reaches a region close to the opposite edge 218, and the insulation sheet 310 is also formed to reach the region close to the opposite edge 218 so as to correspond to the coil 330.

When the antenna is thus arranged, wide directivity between a direction perpendicular to the front surface 212 and the rear surface 214 of the soft magnetic body 200 and another direction perpendicular to the specific edge 216 can be obtained.

Moreover, the coil sheet 300 according to the present embodiment has a structure which is suitable to be attached to the inside of the portable electronic apparatus. Especially, the insulation sheet 310 has not a size only corresponding to the coil 330 but a size rather larger than the coil 330. More specifically, in the coil sheet 300 according to the present embodiment, although the section surrounded by the coil 330 has a part located on the front surface 212 of the soft magnetic body 200 which is very different from another part located on the rear surface 214, the size of the insulation sheet 310 is configured so that the part located on the front surface 212 of the soft magnetic body 200 has almost the same size as the part located on the rear surface 214. In short, the insulation sheet 310 reaches a region close to the opposite edge 218 even over the rear surface 214 of the soft magnetic body 200. Thus, a part of the insulation sheet 310, which extends on the rear surface 214 of the soft magnetic body 200 from an end of the coil 330 toward the opposite edge 218 and which does not have the coil formed thereon, functions as a level difference eliminating portion 312 eliminating a level difference between a region where the coil is formed and another region where the coil is not formed.

The antenna device 100 according to the present embodiment is arranged within the inside of the portable electronic apparatus such as a portable phone so that the rear surface 214 of the soft magnetic body 200 faces the conductor via the insulator. The aforementioned conductor includes, for example, a conductive pattern on a circuit board included within the portable electronic apparatus and a metal case. Upon the aforementioned arrangement, since a rear surface of the antenna device 100 is fixed in the apparatus by using a double sided tape or the like, an adhesive surface of the double sided tape might not become flat to have weak adhesive strength if the aforementioned level difference eliminating portion 312 is not provided. In contrast, when the aforementioned level difference eliminating portion 312 is provided, high adhesive strength can be obtained since the adhesive surface of the double sided tape becomes flat.

Figure 4:
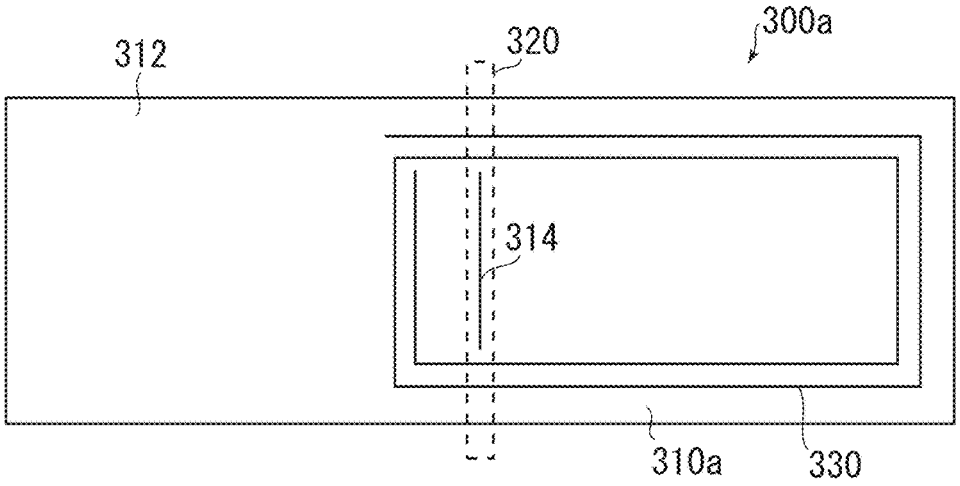
FIG. 4 is a view showing a modification of the coil sheet of FIG. 3.
Figure 5:
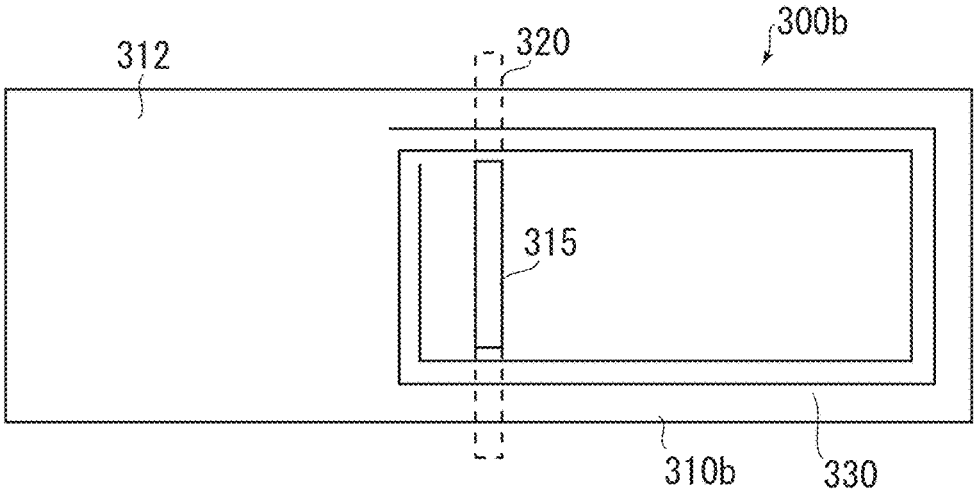
FIG. 5 is a view showing another modification of the coil sheet of FIG. 3.
Figure 6:
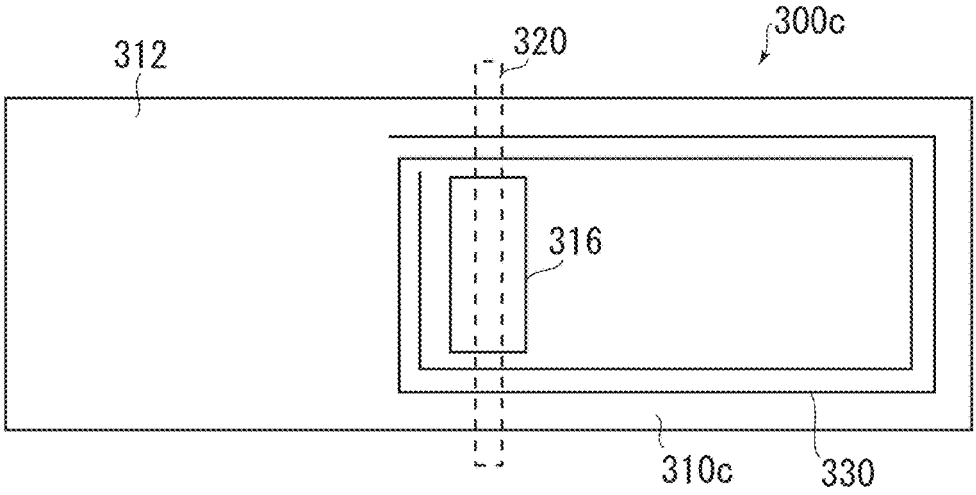
FIG. 6 is a view showing still another modification of the coil sheet of FIG. 3.

The coil sheet 300 of the antenna device 100 is not limited to the aforementioned embodiment but may be modified as described below so as to improve degree of adhesion between the coil sheet and the soft magnetic body 200. For example, as shown in FIG. 4, an insulation sheet 310*a* of a coil sheet 300*a* may be formed with a slit (cut) 314. In this case, the slit 314 is located in the surrounded section surrounded by the coil 330 and in the region 320 corresponding to the specific edge 216 of the soft magnetic body 200. Moreover, as shown in FIG. 5, an insulation sheet 310*b* of a coil sheet 300*b* may be formed with a slit (narrow hole) 315. Similarly, in this case, the slit 315 is located in the surrounded section surrounded by the coil 330 and in the region 320 corresponding to the specific edge 216 of the soft magnetic body 200. Moreover, as shown in FIG. 6, an insulation sheet 310*c* of a coil sheet 300*c* may be formed with an opening 316. In this case, the opening 316 is located in the surrounded section surrounded by the coil 330 and is formed to extend over the region 320 corresponding to the specific edge 216 of the soft magnetic body 200. In other words, the opening 316 is formed from the front surface 212 to the rear surface 214 of the soft magnetic body 200 so as to include a part of the specific edge 216. When each of these slits 314, 315 and opening 316 is provided, each of the coil sheets 300*a* to 300*c* is prevented from being warped at the specific edge 216 when bonded and fixed to the soft magnetic body 200 so that each of the coil sheets 300*a* to 300*c* can be more securely bonded to the soft magnetic body 200.

Figure 7:
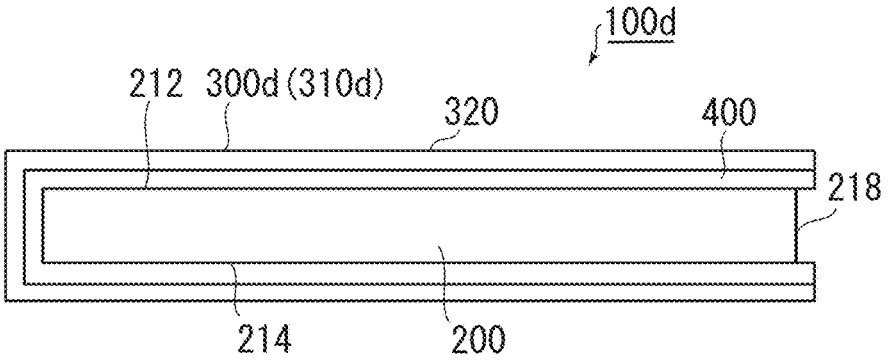
FIG. 7 is a side view showing a modification of the antenna device of FIG. 1.

Moreover, as understood from a coil sheet 300*d* of an antenna device 100*d* shown in FIG. 7, an insulation sheet 310*d*, which is configured to extend from the specific edge 216 beyond the opposite edge 218, may adhere to the soft magnetic body 200 via an adhesive layer 400. When thus configured, the adhesive layer 400 can receive particles which come off an end of the soft magnetic body 200.

Although the particles are received more effectively when the adhesive layer 400 is provided, the receiving effect of the particles can be obtained even when only the insulation sheet 310*d* without the adhesive layer 400 is formed to extend beyond the opposite edge 218 in comparison with a case where the extended part is not formed.

Figure 8:
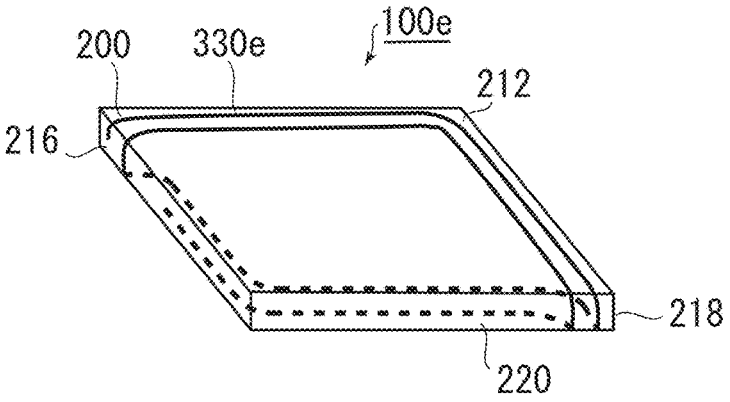
FIG. 8 is a perspective view showing another modification of the antenna device of FIG. 1.
Figure 9:
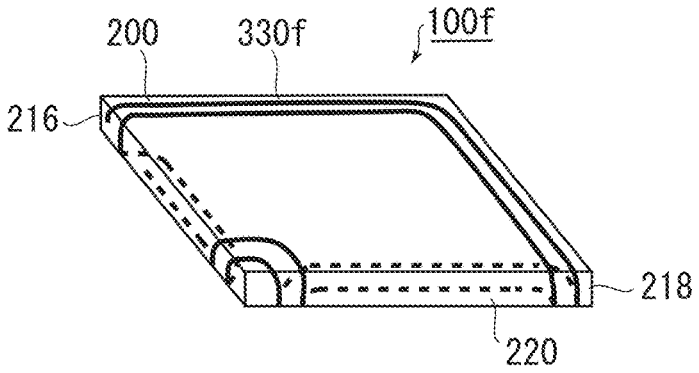
FIG. 9 is a view showing still another modification of the antenna device of FIG. 1.
Figure 10:
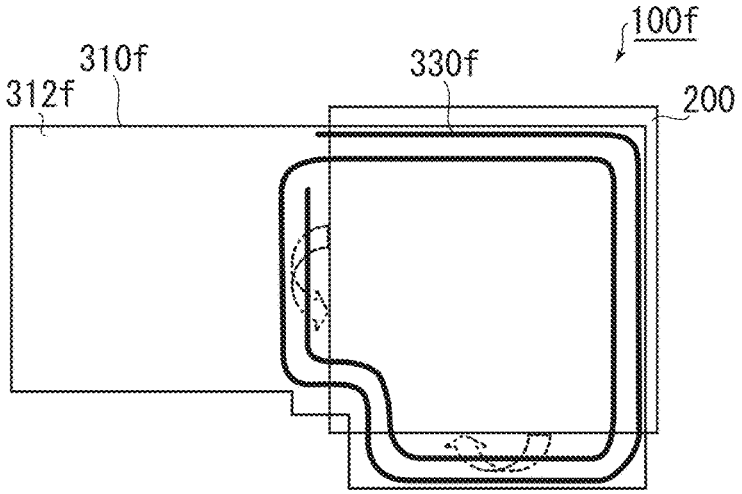
FIG. 10 is a view showing a making process of the antenna device of FIG. 9.

Moreover, as understood from antenna devices 100*e* and 100*f* shown in FIGS. 8 and 9, respectively, a surrounded area surrounded by one of a coil 330*e* and 330*f* on the soft magnetic body 200 may be configured to enclose, at least in part, an adjacent edge 220 which is adjacent to the specific edge 216. In this case, in addition to the wide directivity between the direction perpendicular to the front surface 212 and the rear surface 214 of the soft magnetic body 200 and the direction perpendicular to the specific edge 216, additional wide directivity between the direction perpendicular to the front surface 212 and the rear surface 214 of the soft magnetic body 200 and a direction perpendicular to the adjacent edge 220 can be obtained. Thus, a communication along any one of three axes can be achieved by using each of the antenna devices 100*e* and 100*f* shown in FIGS. 8 and 9, respectively. The antenna device 100*f* of FIG. 9 is formed by placing an insulation sheet 310*f*, which is formed with the coil 330*f* as shown in FIG. 10, on the front surface 212 of the soft magnetic body 200 and bending and fixing a part thereof to the rear surface 214. In this case, a level difference eliminating portion 312*f* of the insulation sheet 310*f* has a shape where a predetermined part is cut so that the predetermined part is prevented from overlapping with a neighboring part of the adjacent edge 220 to form another level difference when bent to the rear surface 214 of the soft magnetic body 200.

Figure 11:
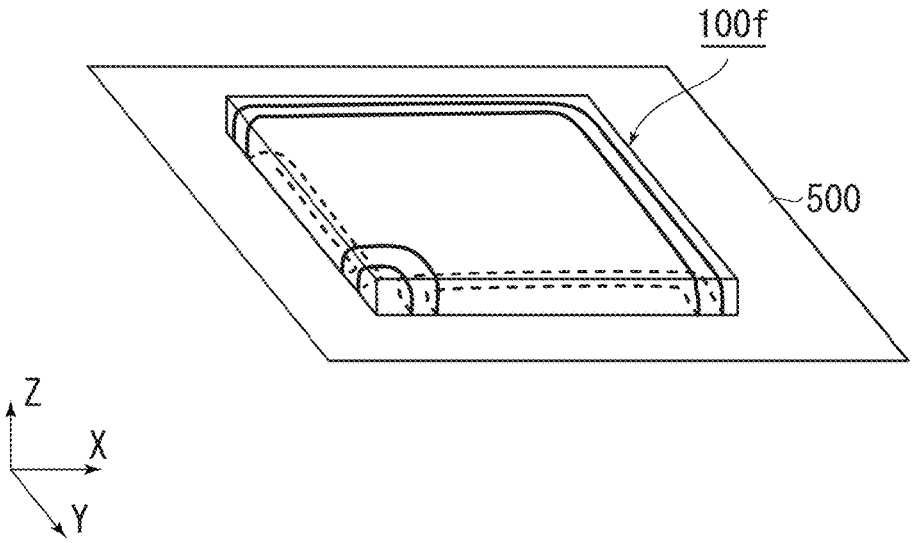
FIG. 11 is a view schematically showing a target, which includes the antenna device of FIG. 9, for evaluating magnetic field strength.
Figure 12:
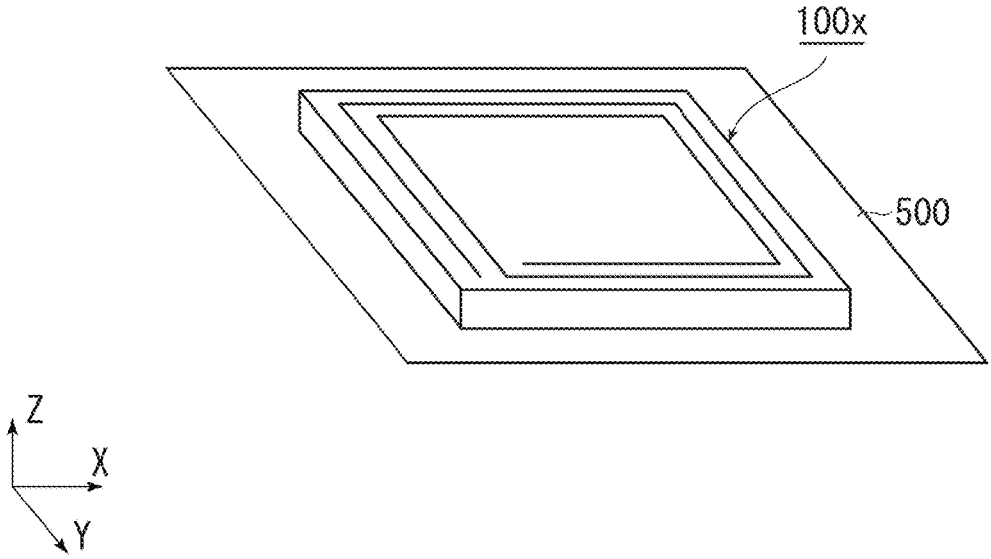
FIG. 12 is a view schematically showing target, which includes an antenna device of Comparative Example, for evaluation of magnetic field strength.

As shown in FIGS. 11 and 12, evaluation targets, which include the antenna device 100*f* shown in FIG. 9 and an antenna device 100*x* of Comparative Example arranged on the respective boards 500, are made and tested by electromagnetical field simulation; the results are shown in FIGS. 13 to 15 and FIGS. 16 to 18.

Figure 13:
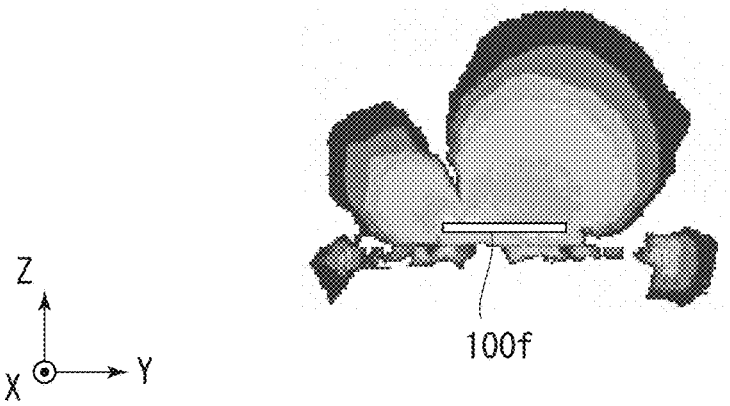
FIG. 13 is a view showing spatial distribution of the Z-component of density of magnetic flux radiated from the evaluation target of FIG. 11.
Figure 14:
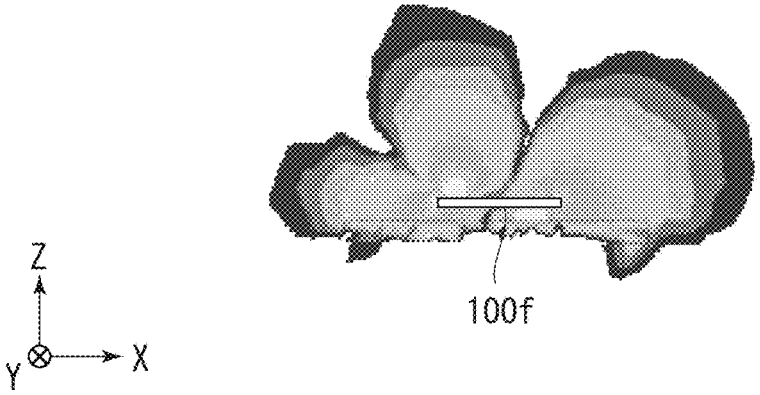
FIG. 14 is a view showing spatial distribution of the X-component of density of magnetic flux radiated from the evaluation target of FIG. 11.
Figure 15:
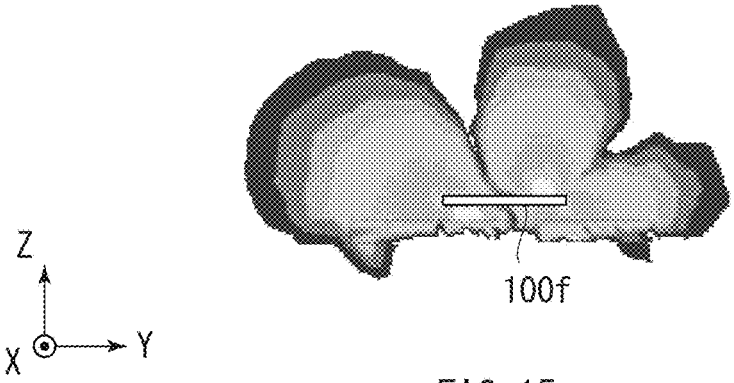
FIG. 15 is a view showing spatial distribution of the Y-component of density of magnetic flux radiated from the evaluation target of FIG. 11.

FIG. 13 shows spatial distribution of the component perpendicular to the soft magnetic body (the component in the Z-direction) of magnetic field which is radiated from the antenna coil excited by the current flowing through the antenna coil of the antenna device shown in FIG. 11. FIGS. 14 and 15 show the respective spatial distributions of the components in parallel to the soft magnetic body (the components in the X-direction and the Y-direction) of the magnetic field which is radiated from the antenna coil excited by the current flowing through the antenna coil of the antenna device of FIG. 11.

Figure 16:
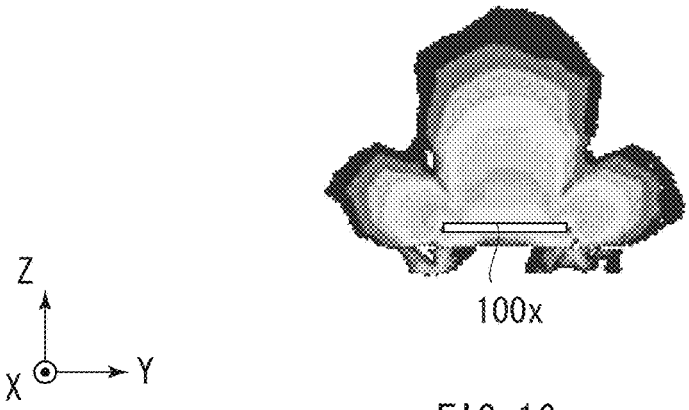
FIG. 16 is a view showing spatial distribution of the Z-component of density of magnetic flux radiated from the evaluation target of FIG. 12.
Figure 17:
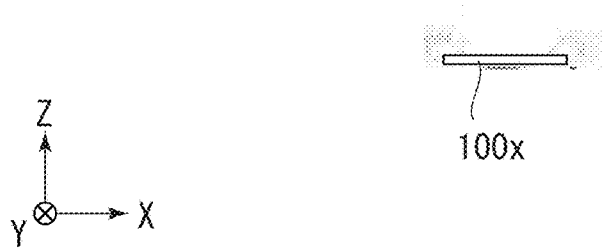
FIG. 17 is a view showing spatial distribution of the X-component of density of magnetic flux radiated from the evaluation target of FIG. 12.
Figure 18:
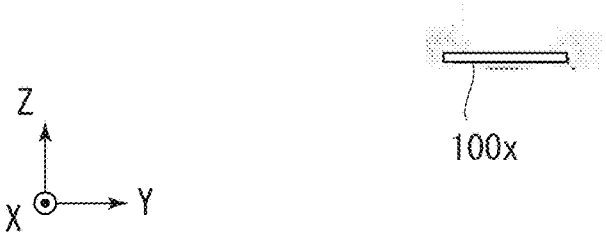
FIG. 18 is a view showing spatial distribution of the Y-component of density of magnetic flux radiated from the evaluation target of FIG. 12.

FIG. 16 shows spatial distribution of the component perpendicular to the soft magnetic body (the component in the Z-direction) of magnetic field which is radiated from the antenna coil excited by the current flowing through the antenna coil of the antenna device of Comparative Example shown in FIG. 12. FIGS. 17 and 18 show respective spatial distributions of the components in parallel to the soft magnetic body (the components in the X-direction and the Y-direction) of the magnetic field which is radiated from the antenna coil excited by the current flowing through the antenna coil of the antenna device of FIG. 12.

The turn number of the antenna coil of each of the antenna device of FIG. 11 and the antenna device of FIG. 12 is set to five. The simulation is done in a state where a conductor, which corresponded to the circuit board of the portable electronic apparatus, is simulatively arranged under the soft magnetic body. Electromagnetical field simulator Maxwell3D of AnSoft Corporation is used for thus arranged electromagnetical field simulation.

In comparison between the antenna device of FIG. 11 and the comparative antenna device of FIG. 12, their intensity distribution of the component perpendicular to the soft magnetic body (the component in the Z-direction) of the magnetic field radiated from the antenna coil have the spreads almost same as each other. Accordingly, when a communication target is located in the Z-direction of the antenna device, the antenna device of FIG. 11 can have a communication distance nearly equal to that of the antenna device of Comparative Example of FIG. 12.

In contrast, considering the intensity distribution of each of the components in parallel to the soft magnetic body (the components in the X-direction and the Y-direction) of the magnetic field radiated from the antenna coil, in comparison between the antenna device of FIG. 11 and the antenna device of FIG. 12, the intensity distribution of the magnetic field of the antenna device of FIG. 11 has the spread nearly equal to the aforementioned spread of the intensity distribution of the magnetic field in the Z-direction while the intensity distribution of the magnetic field of the antenna device of FIG. 12 has the extremely narrow spread. Accordingly, when a communication target is located in the X-direction or the Y-direction of the antenna device, the antenna device of FIG. 11 has an extremely increased communication distance in comparison with the antenna device of FIG. 12. Moreover, the present embodiment also has a remarkable effect that the intensity distribution of the magnetic field in each of the X-direction and the Y-direction spreads not only in a facing direction of a side surface which is provided with the opening thereon but also in a facing direction of its opposite side surface. If the coil is provided so as to extend not only over the specific edge but also over the opposite edge, similar to the existing antenna device shown in FIG. 12, the aforementioned spread of the intensity distribution of the magnetic field cannot be achieved.

Figure 19:
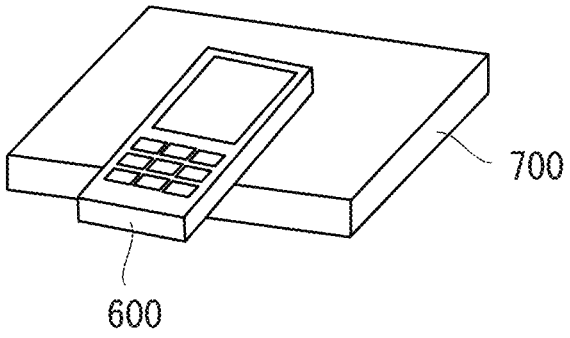
FIG. 19 is a view schematically showing a formation upon communication between a portable electronic apparatus and a reader/writer.

Suppose the existing communication module or the communication module according to the present embodiment is mounted in a portable electronic apparatus (for example, a portable phone) 600 having a thin and long box-like case shape. If the communication target of the portable electronic apparatus 600 is a reader/writer 700 which is placed to be fixed, the number of the surfaces, which are of the case of the portable electronic apparatus 600 and which can be used in the communication, is only one (see FIG. 19) in a case where the portable electronic apparatus 600 is provided with the existing communication module. This type of arrangement between the portable electronic apparatus 600 and the reader/writer 700 is often used in a case where the portable electronic apparatus 600 serves as an IC card for payment, and is used in a present main communication method.

Figure 20:
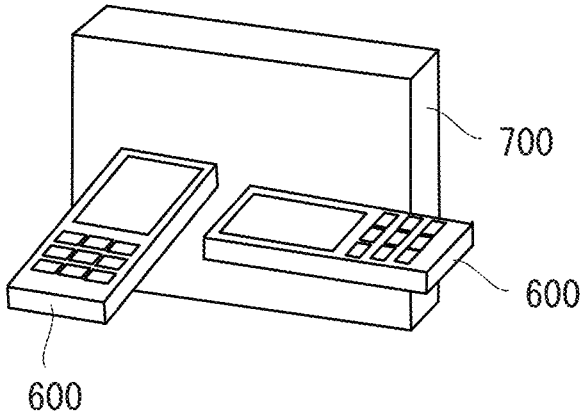
FIG. 20 is a view schematically showing another formation upon communication between the portable electronic apparatus and the reader/writer.

On the other hand, when the portable electronic apparatus 600 is provided with the communication module according to the present embodiment, the number of the surfaces, which are of the case of the portable electronic apparatus 600 and can be used in the communication, becomes two or three (see FIGS. 20 and 21) so that labor for such action that a user repositions the portable electronic apparatus 600 upon an actual use is reduced. Especially, the reader/writer 700 is required to be arranged vertically when a floor space for placing the reader/writer 700 is limited, such as a vending machine for product and a platform of a bus or a tram; accordingly, considering the suitability for the holding style of the portable phone upon a telephone call, it is desirable that the portable electronic apparatus 600 and the reader/ writer 700 can communicate with each other under the arrangement shown in FIG. 20.

Moreover, in a communication between the portable electronic apparatus 600, the number of the surfaces, which are of the case of the portable electronic apparatus 600 and can be used in the communication, is only one (see FIG. 21) when the portable electronic apparatus 600 is provided with the existing communication module. However, combinations (a part of which is shown in each of FIG. 22 and FIG. 23) of square of the number of the communicatable surfaces of each of the portable electronic apparatus 600 are allowed in the arrangements each of which enables the communication between the portable electronic apparatus 600 provided with the respective communication modules according to the present embodiment so that the labor for the action of the user can be reduced.

Although the above description exemplarily shows the communication between the portable electronic apparatus 600 having the same shape as each other, when the communication between the portable electronic apparatus 600 having different shapes from each other, for example, the communication between the portable electronic apparatus 600 and a game machine, is required, the labor of the user is more largely reduced since the labor for searching the communicatable surface of each user is reduced because of the increase of the communicatable surfaces.

Figure 21:
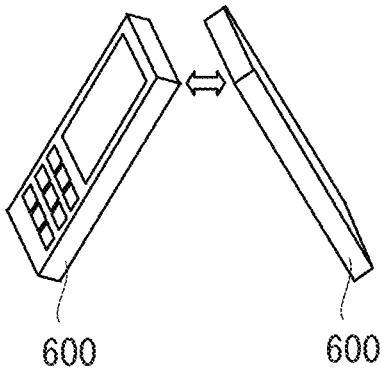
FIG. 21 is a view schematically showing a formation upon communication between portable electronic apparatus.
Figure 22:
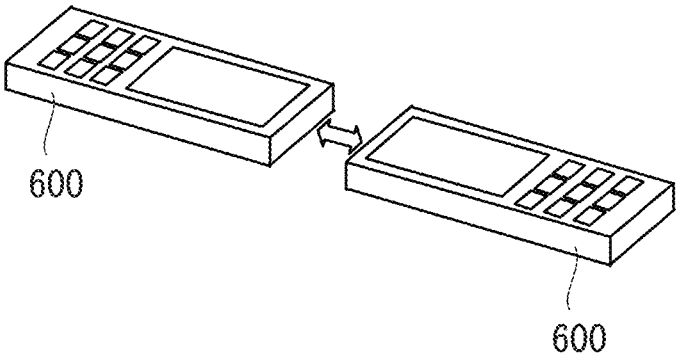
FIG. 22 is a view schematically showing another formation upon communication between the portable electronic apparatus.
Figure 23:
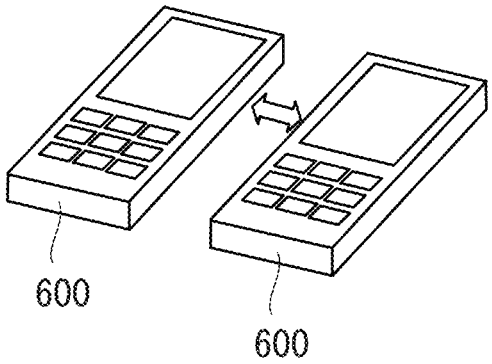
FIG. 23 is a view schematically showing another formation upon communication between the portable electronic apparatus.
Figure 24:
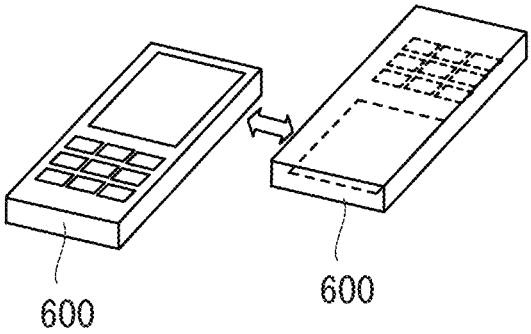
FIG. 24 is a view schematically showing another formation upon communication between the portable electronic apparatus.
Figure 25:
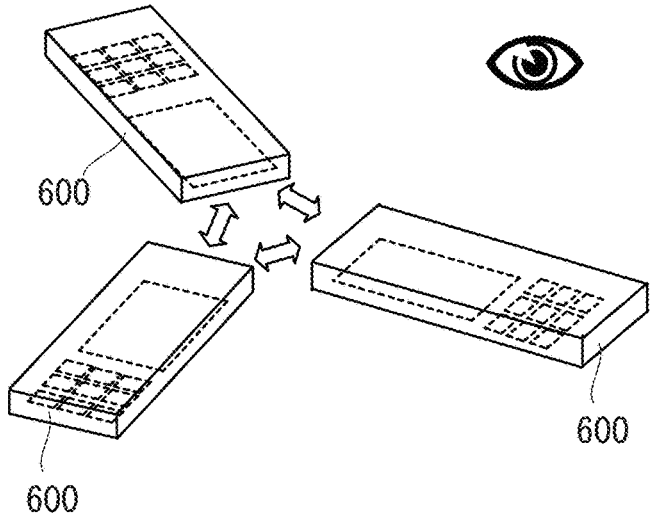
FIG. 25 is a view schematically showing another formation upon communication between the portable electronic apparatus.
Figure 26:
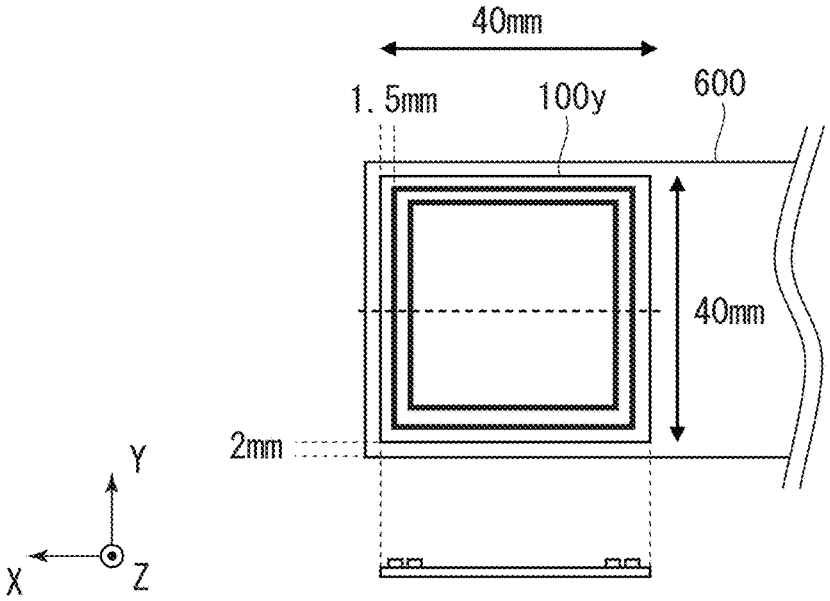
FIG. 26 is a view schematically showing an antenna device of Comparative Example 1.
Figure 27:
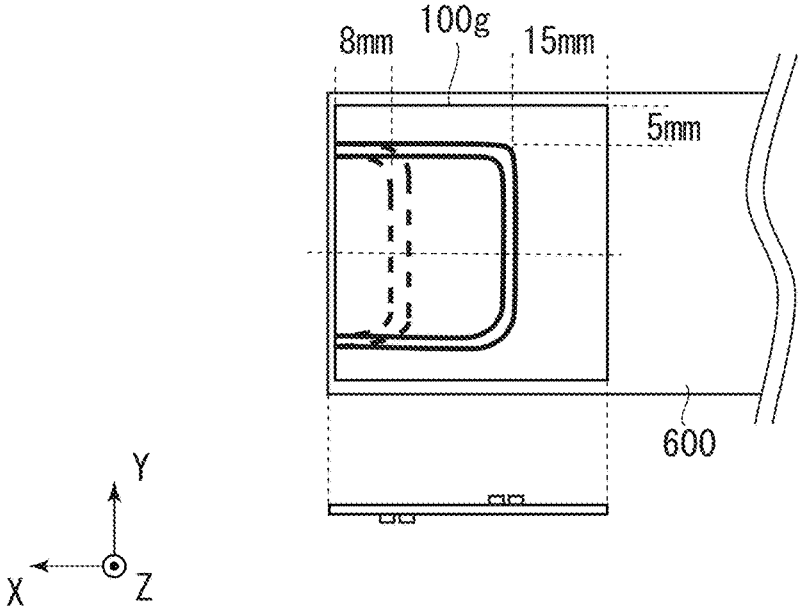
FIG. 27 is a view schematically showing an antenna device of Example 1.
Figure 28:
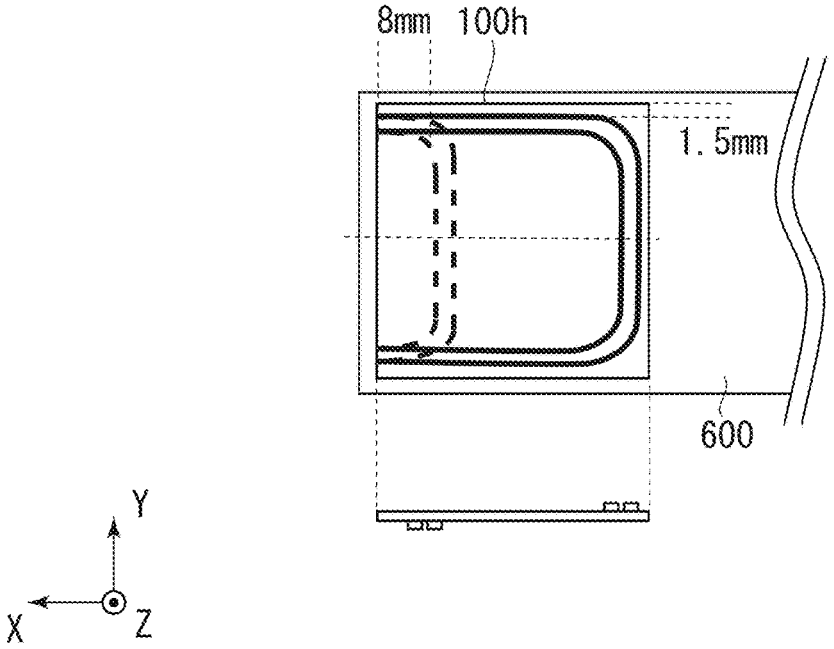
FIG. 28 is a view schematically showing an antenna device of Example 2.
Figure 29:
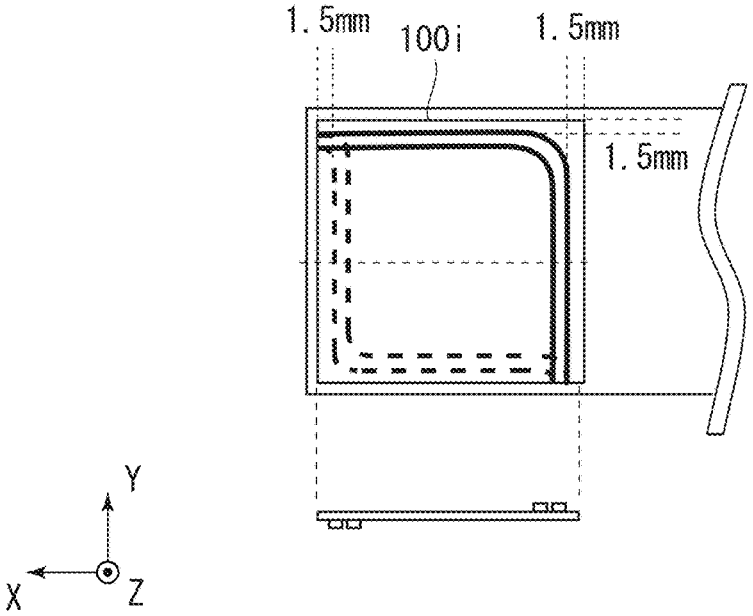
FIG. 29 is a view schematically showing an antenna device of Example 3.

Moreover, for example, when the communication between the portable electronic apparatus 600 placed on a table is required, since it is difficult to arrange the portable electronic apparatus 600 as shown in FIG. 21, it is necessary to secure communication by using the arrangement shown in one of FIGS. 22 to 25. Moreover, in view of ensuring privacy upon the communication, the communication in the arrangement as shown in FIG. 25 is desirable in order to prevent the display surface of the portable electronic apparatus 600 from being viewed by another person.

As described above, considering the communication between the portable electronic apparatus 600, in comparison with the communication between the portable electronic apparatus 600 and the reader/writer 700 which is mainly used presently, the merit of providing the communication module according to the present embodiment is not limited to the improvement of convenience but should be said to be essential for completion of functions. Of course, it goes without saying that the communication performance should be ensured under the arrangement shown in FIG. 19 which is mainly used presently even if the portable electronic apparatus 600 are communicatable with each other.

EXAMPLE 1

Hereafter, explanation will be made about results of evaluating the effect of the present invention in addition to details of an implement method, wherein various antenna devices are made by combining a sheet, which is made of a mixture of a soft magnetic metal powder having flat shape and a resin, a loop antenna coil and a variable capacitor for adjusting resonant frequency.

(Making of a Thin Sheet Formed with a Loop Antenna Pattern)

A loop antenna coil was formed by bonding a rectangular copper wire, which has a conductive cross-section of 0.1 mm square, to a surface of a sheet having soft magnetism. The interval between lines of the copper wire was 1.5 mm and the winding number was five.

(Making of a Soft Magnetic Sheet Which was Made of a Mixture of a Soft Magnetic Metal Powder Having Flat Shape and a Resin)

BUSTERAID (registered mark) of NEC TOKIN Corporation was used as a soft magnetic sheet which was made of a mixture of a soft magnetic metal powder having flat shape and a resin. This soft magnetic sheet had a square-shape having each side of 40 mm and had a thickness of 0.2 mm. The relative permeability in the surface of the soft magnetic sheet under the room temperature was 130 at a measuring frequency of 13.56 MHz.

(Making of Antenna Devices, in Each of Which the Soft Magnetic Sheet and the Loop Antenna Sheet Were Integrated with Each Other)

In order for the soft magnetic sheet and the loop antenna sheet, which were obtained as described above, to form the structures shown in FIGS. 26 to 29, the soft magnetic sheet was bonded to and combined with the loop antenna so that antenna devices 100*y* and 100*g* to 100*i*, in each of which the soft magnetic sheet and the loop antenna sheet were integrated with each other, were made.

Figure 30:
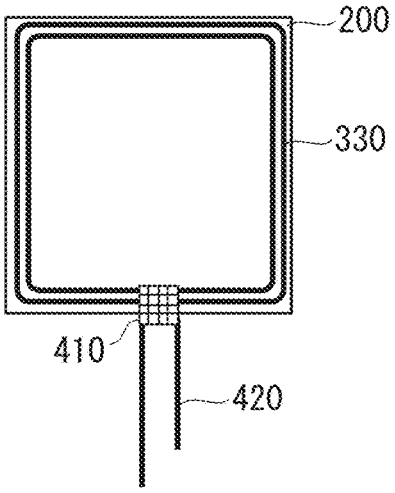
FIG. 30 is a view for supplementing the antenna devices of FIGS. 26 to 29.

Lead wires 420 were connected to each of these antenna devices 100*y* and 100*g* to 100*i* by Pb-free soldering, while a capacitor 410 for adjusting resonant frequency was attached between the ends of the loop antenna coil in parallel to the loop antenna coil (see FIG. 30). The number of each of the antenna devices 100*y* and 100*g* to 100*i* which were made was two.

(Impedance Matching)

Hereafter, explanation will be made about an evaluation system for matching the impedance of each of the antenna devices 100*y* and 100*g* to 100*i* which were obtained as described above.

The antenna devices 100*y* and 100*g* to 100*i* were attached to the respective portable electronic apparatus 600. Specifically, for evaluation, a circuit board of a simulative portable phone simulating a portable electronic apparatus was placed under each of the antenna devices 100*y* and 100*g* to 100*i*, wherein a board pattern was formed on the simulative circuit board to serve as a source of eddy current. After the antenna adhered to an antenna mounting position via an adhesive layer of 30 μm, impedance was confirmed to be matched. Vector network analyzer 8753ES of Agilent Technologies, Inc. was used for the measurement.

The condition where the impedance was matched was that a resonant frequency was 13.56 MHz at S11 of the network analyzer and the impedance thereof at the resonant frequency was 50Ω.

(Configuring a Measurement System for Measuring a Communication Distance)

HF-band Contactless IC card reader/writer ICT-3039-1 of NEC TOKIN Corporation was used as the reader/writer 700 for evaluation of a communication distance. For the purpose of making a virtual IC tag by using the antenna device according to the present invention, an HF-band IC chip compliant with ISO/IEC15693 standard was connected to the lead wires of the antenna device attached to the simulative portable phone so that the simulative portable electronic apparatus 600 was made. If a communication distance of 20 mm can be obtained under the measuring environment of the present Example, the communication distance according to the standard is also achieved under a field test where an actual portable phone in an active state is used.

Figure 31:
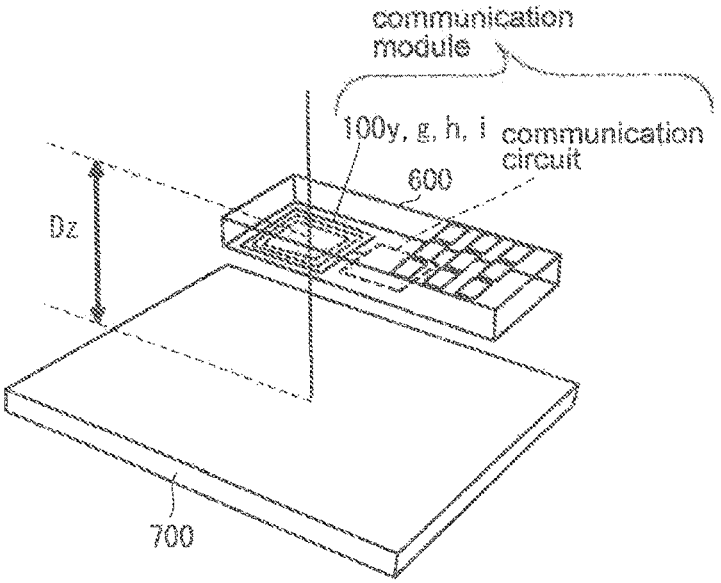
FIG. 31 is a view schematically showing a system for evaluation of communication distance in the Z-direction.
Figure 32:
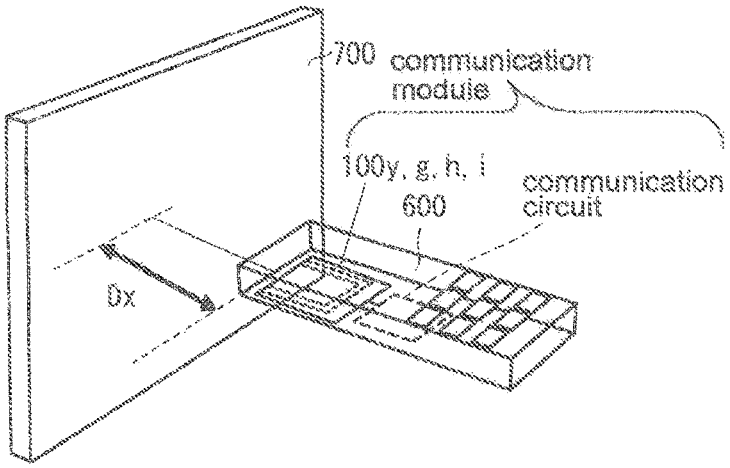
FIG. 32 is a view schematically showing a system for evaluation of communication distance in the X-direction.
Figure 33:
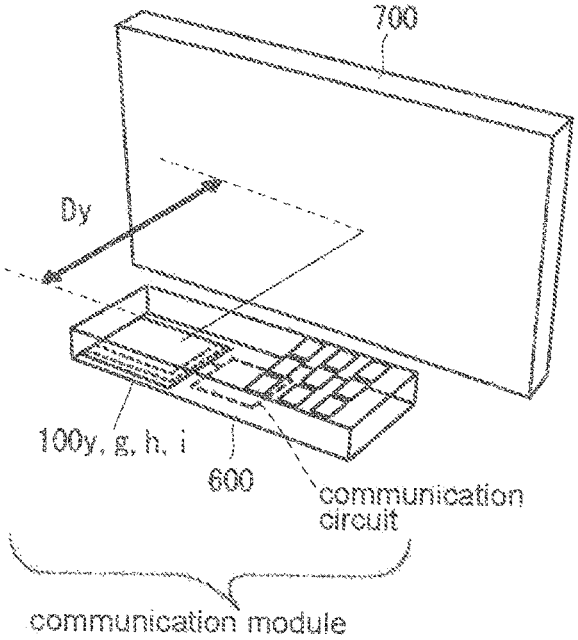
FIG. 33 is a view schematically showing a system for evaluation of communication distance in the Y-direction.
Figure 34:
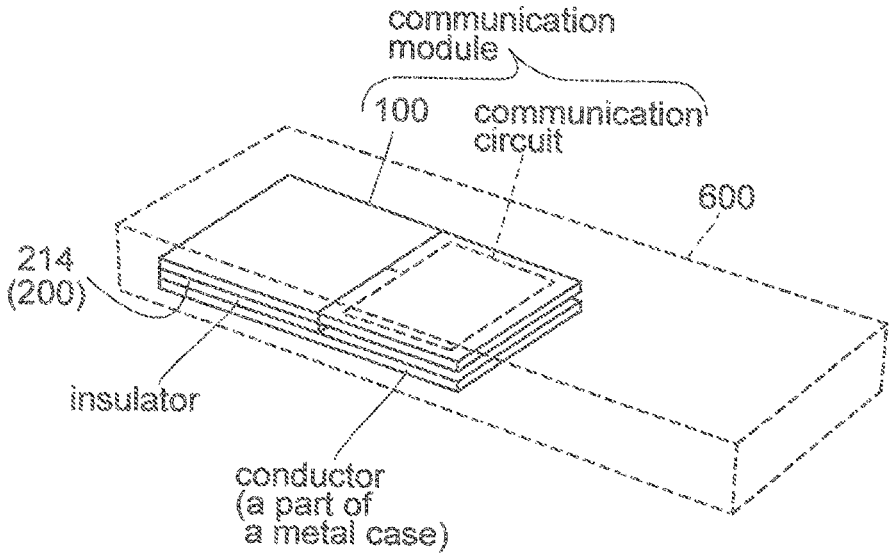
Figure 35:
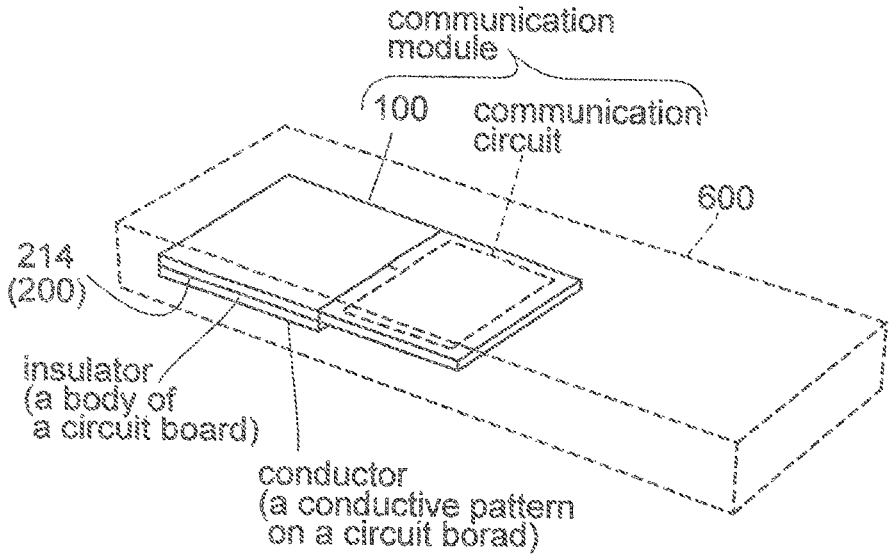

As shown in FIGS. 31 to 33, in the measurement of the communication distance, under a state where the reader/writer 700 and the portable electronic apparatus 600 faced each other, a maximum distance where the communication was enabled between the two was measured.

Table 1 shows values of the communication distances measured in the measurement system which was configured as described above.

TABLE 1

| | Communication Distance in the Z-direction Dz (mm) | Communication Distance in the X-direction Dx (mm) | Communication Distance in the Y-direction Dy (mm) |
|---|---|---|---|
| Comparative Example 1 (FIG. 26) | 95 | 0 | 0 |
| Example 1 (FIG. 27) | 21 | 20 | 0 |
| Example 1 (FIG. 28) | 65 | 55 | 0 |
| Example 1 (FIG. 29) | 60 | 40 | 35 |

As shown in Table 1, according to an existing standard technique or Comparative Example 1, a sufficient communication distance can be obtained in the Z-direction while a communication distance in the X-direction becomes 0 mm and is disadvantageous.

According to Example 1, although the opening of the antenna coil in the plate surface of the magnetic sheet is insufficient, a communication distance of 21 mm is obtained in the Z-direction.

According to the configuration of each of Example 2 and Example 3, although a communication distance in the Z-direction is seen to be degraded relative to Example 1, a communication distance of not less than 50 mm is obtained; thus, a communication distance of practically sufficient value is obtained. Moreover, each communication distance in the X-direction is seen to be largely extended. Thus, the directivity is remarkably improved so that the desired object of the present invention, or the improvement of the directivity of the antenna is achieved.

Moreover, only according to the configuration of Example 3, a communication in the Y-direction is achieved; thus, the desired object of the present invention, or the improvement of the directivity of the antenna, is achieved at higher level.

As described above, the antenna device according to the present invention can dramatically extend a communication distance in a direction parallel to the plate surface of the soft magnetic body while keeping a communication distance in a main communication direction in an actual use, or in a direction perpendicular to the plate surface of the soft magnetic plate. Moreover, since a main part of the antenna coil is formed on the plate surface of the soft magnetic plate, it is suitable to make the shape thinner in comparison with a structure where the coil is wound in such a manner that the coil axis of the antenna coil is in parallel to the plate surface of the soft magnetic plate.

In the aforementioned Examples, the mixture of the soft magnetic flat metal powder and the resin is used as the soft magnetic body and the rectangular wire is used as the coil. However another soft magnetic body such as a ferrite may be used as the soft magnetic plate. Moreover, the coil pattern may be printed directly on the surface of the soft magnetic body or may be formed by using an FPC (Flexible Printed Circuits).

Moreover, in the aforementioned Examples, it is described about the send and receive between the simulative portable phone and the reader/writer, but it goes without saying that the effect of the improvement of the directivity can be obtained even in the communication between the portable electronic apparatus in each of which the antenna device according to the present invention is mounted.

The above explanation is intended to explain the effects according to the embodiment of the present invention but is intended neither to limit the invention described in CLAIMS nor to restrict CLAIMS. Moreover, it goes without saying that the structure of each portion according to the present invention is not limited to the aforementioned embodiment but can be modified variously within a technical scope described in CLAIMS.

REFERENCE SIGNS LIST

100, 100*d*, 100*f*, 100*g*, 100*h*, 100*i*, 100*x*, 100*y* antenna device
200 soft magnetic body
212 front surface
214 rear surface
216 specific edge
218 opposite edge
220 adjacent edge
300, 300*a*, 300*b*, 300*c*, 300*d*, 300*e*, 300*f* coil sheet
310, 310*a*, 310*b*, 310*c*, 310*d*, 310*f* insulation sheet
312 level difference eliminating portion
314, 315 slit
316 opening
320 region
330, 330*e*, 330*f* coil (conductive pattern)
400 adhesive layer
410 capacitor
420 lead wire
500 board
600 portable electronic apparatus
700 reader/writer

The invention claimed is:

1. An antenna device comprising: a rectangular plate-like soft magnetic body provided with a loop-like coil, wherein:

the coil is formed of a conductive pattern and formed on an insulation sheet; the coil is disposed from a front surface to a rear surface of the soft magnetic body so that a section surrounded by the coil on the insulation sheet overlaps with, at least in part, a first edge of the soft magnetic body which is one of four edges of the soft magnetic body, and does not overlap with an opposite edge of the soft magnetic body that is opposite to the first edge;

the coil of the conductive pattern is configured so that an area, which is in the front surface of the soft magnetic body and included in the section surrounded by the coil on the insulation sheet, is larger than another area, which is in the rear surface of the soft magnetic body and included in the section surrounded by the coil on the insulation sheet;

the coil reaches a region close to the opposite edge over the front surface of the soft magnetic body such that the coil has wide directivity between a direction perpendicular to the front surface of the soft magnetic body and another direction perpendicular to the first edge;

the insulation sheet has a front part located on the front surface of the soft magnetic body, a rear part located on the rear surface of the soft magnetic body, and a middle part located on the first edge of the soft magnetic body;

the front part of the insulation sheet located on the front surface of the soft magnetic body has a same size as the rear part of the insulation sheet located on the rear surface of the soft magnetic body, and the middle part of the insulation sheet located on the first edge of the soft magnetic body is arranged between the front part and the rear part;

when the insulation sheet is expanded into a planar plane together with the coil so as to extend along a predetermined direction, the middle part is located at a middle of the insulation sheet in the predetermined direction between the front part and the rear part, a majority portion of the coil is located on the front part of the insulation sheet in the predetermined direction and only a rear end portion of the coil having a length in the predetermined direction that is smaller than a length of the majority portion of the coil in the predetermined direction is located on the rear part of the insulation sheet; and the insulation sheet is folded around the magnetic body such that the middle part is located on the first edge of the soft magnetic body, and such that the rear end portion of the coil is located on the rear surface of the soft magnetic body at a position closer to the first edge than to the opposite edge; and the coil is entirely arranged on the front surface, the rear surface and at least one of the four edges of the soft magnetic body, including the first edge, via the insulation sheet.

2. The antenna device as recited in claim 1, wherein the insulation sheet comprises a level difference eliminating portion eliminating a level difference between the section as well as a region including the conductive pattern and another region not including the conductive pattern when the antenna device is attached to an object, the level difference eliminating portion extending on the rear surface of the soft magnetic body from the conductive pattern toward the opposite edge of the soft magnetic body.

3. The antenna device as recited in claim 1, wherein the insulation sheet comprises a slit which extends along a longitude direction of the first edge, and is formed at a part of the insulation sheet located on the first edge.

4. The antenna device as recited in claim 1, wherein the insulation sheet comprises an opening which is formed so as to include a region on the first edge.

5. The antenna device as recited in claim 1, wherein the insulation sheet extends on the front surface and the rear surface of the soft magnetic body from the first edge beyond the opposite edge.

6. The antenna device as recited in claim 1, wherein a thickness of the soft magnetic body is at least 0.1 mm and at most 2.0 mm.

7. The antenna device as recited in claim 1, wherein the section surrounded by the coil on the insulation sheet overlaps, at least in part, one adjacent edge which is adjacent to the first edge of the soft magnetic body.

8. A communication module comprising:

the antenna device as recited in claim 1; and a communication circuit connected with the antenna device.

9. A portable electronic apparatus comprising the communication module as recited in claim 8.

10. The portable electronic apparatus as recited in claim 9, wherein the communication module is arranged so that the rear surface of the soft magnetic body faces a conductor and the antenna device is located over the conductor via an insulator, said portable electronic apparatus comprising:

said conductor, wherein the conductor is a metal case or a conductive pattern on a circuit board which is located in a portable electronic apparatus; and said insulator.

* * * * *